US007669817B2

(12) United States Patent
Scott

(10) Patent No.: US 7,669,817 B2
(45) Date of Patent: Mar. 2, 2010

(54) MOUNTING BRACKET

(75) Inventor: Jon Peter Scott, Hackham (AU)

(73) Assignee: Krix Loudspeakers Pty Ltd., Hackman, South Australia ( * ) Notice: Subject to any disclaimer, the term of this patent is extended or adjusted under 35 U.S.C. 154(b) by 0 days.

(21) Appl. No.: 12/284,255

(22) Filed: Sep. 18, 2008

(65) Prior Publication Data

US 2009/0072102 A1 Mar. 19, 2009

(51) Int. Cl.
*A47B 96/06* (2006.01)

(52) U.S. Cl. ..... 248/205.1; 248/201

(58) Field of Classification Search ..... 248/205.1, 248/201, 200, 475.1
See application file for complete search history.

(56) References Cited

U.S. PATENT DOCUMENTS 4,184,726 A 1/1980 Cox
4,475,705 A * 10/1984 Henneberg et al. ..... 248/447.2
5,295,653 A * 3/1994 Miyazaki et al. ..... 248/675
5,964,438 A * 10/1999 Camilleri ..... 248/225.21
6,484,983 B1 11/2002 Combest
6,845,840 B2 1/2005 Cowan et al.
6,938,864 B2 * 9/2005 Simonian et al. ..... 248/200
2004/0004169 A1 * 1/2004 Hays ..... 248/229.16
2005/0061943 A1 * 3/2005 Holden ..... 248/500

* cited by examiner

*Primary Examiner*—Ramon O Ramirez
(74) *Attorney, Agent, or Firm*—Klauber & Jackson L.L.C.

(57) ABSTRACT

A reversible mounting bracket for mounting an article such as a loudspeaker is disclosed. The reversible mounting bracket in a first configuration is adapted to mount the article substantially flush to an upright mounting surface and in a second configuration, wherein the mounting bracket is reversed in orientation with respect to the article, the mounting bracket is adapted to mount the article to a mounting member.

18 Claims, 11 Drawing Sheets

MOUNTING BRACKET

RELATED APPLICATIONS

The present application claims priority from Australian Provisional Patent Application No. 2007905087 entitled "Mounting Bracket", filed 18 Sep. 2007. Applicants claim priority under 35 U.S.C. §119 as to the said Australian application, and the entire disclosure of said application is hereby expressly incorporated by reference herein in its entirety.

TECHNICAL FIELD

The present invention relates to a mounting bracket. In a particular form the present invention relates to a mounting bracket for mounting an article such as a loudspeaker upon a wall or a stand.

BACKGROUND

With the popularity of home cinema systems there comes the associated problem of being able to conveniently mount a number of loudspeakers throughout a room. Depending on the configuration of the room, the same or similar speaker type may be required to be directly mounted to a wall or mounted to a mounting member such as a stand. One example of this situation would be the mounting of rear loudspeakers to the back wall of a room and the mounting of the same type of loudspeakers to respective stands at the front of the room.

In the example of wall mounted loudspeakers, it is often a requirement that loudspeakers be mounted flush with the wall. To facilitate this, the loudspeaker cable connectors are typically located within a recess or cavity located at the rear of the loudspeaker. This also protects the cable connectors or terminals from being knocked or damaged during installation and use. In this manner, loudspeaker cable can be provided unseen to the loudspeaker cable connectors via an outlet in the wall directly to the loudspeakers. In the case of stand mounted loudspeakers, it is also often a requirement that the loudspeaker cable be hidden so as not to detract from the aesthetics of the loudspeaker system.

To address this problem, loudspeaker manufacturers will typically provide a number of different types of specialised mounting brackets that are tailored for each mounting requirement. As would be appreciated by those skilled in the art, these mounting brackets each have the requirement of also being able to facilitate cable attachment to the loudspeaker. Clearly, this leads to a great deal of inconvenience to the installer of a loudspeaker system which in some cases may be a professional or alternatively the purchaser of the loudspeaker system. Additionally, the manufacturers of loudspeakers have the additional cost of designing, developing and manufacturing a number of different types of mounting brackets and ensuring that any loudspeaker system that comprises a number of loudspeakers is provided with the relevant number and type of mounting brackets for installation.

There is therefore a need for a mounting bracket that simplifies the mounting of articles such as loudspeakers and the like.

SUMMARY

In a first aspect the present invention accordingly provides a reversible mounting bracket for mounting an article, the reversible mounting bracket in a first configuration adapted to mount the article substantially flush to an upright mounting surface and in a second configuration, wherein the mounting bracket is reversed in orientation with respect to the article, the mounting bracket is adapted to mount the article to a mounting member.

In another form the reversible mounting bracket includes a housing portion, the housing portion in the first configuration adapted to seat within a recess or cavity located on the article and in the second configuration the housing portion is adapted to receive a mounting portion of the mounting member.

In another form in the second configuration the housing portion projects from the article to receive the mounting portion of the mounting member.

In another form in the second configuration the housing portion includes an internal cavity to receive the mounting portion of the mounting member.

In another form in the first configuration the internal cavity of the housing portion receives a projection member of a surface mounting bracket to mount the article substantially flush to the upright mounting surface.

In another form the mounting member is a stand.

In another form the mounting bracket is adapted to allow the article to be mounted in a plurality of directions.

In another form the reversible mounting bracket is adapted to allow the article to be mounted either horizontally or vertically.

In another form the article includes at least one connector located within the recess or cavity of the article and wherein the mounting bracket is adapted to allow a connection line to access the at least one connector.

In another form the connection line is an electrically conductive cable. In another form the mounting bracket is of unitary construction.

In another form the article is a loudspeaker.

In a second aspect the present invention accordingly provides a mounting bracket assembly for mounting an article, the mounting bracket assembly including a reversible mounting bracket and a surface mounting bracket, wherein the reversible mounting bracket in a first configuration is adapted to mount the article to the surface mounting bracket attached to an upright mounting surface so that the article is substantially flush to the upright mounting surface and in a second configuration, wherein the mounting bracket is reversed in orientation with respect to the article, the mounting bracket is adapted to mount the article to the surface mounting bracket at a predetermined distance from the upright mounting surface.

In another form the reversible mounting bracket includes a housing portion having an internal cavity and the surface mounting bracket includes a complementary shaped projection member to the internal cavity of the housing portion for mounting the reversible mounting bracket.

In another form in the first configuration the internal cavity of the housing portion receives the projection member of the surface mounting bracket to mount the article substantially flush to the upright mounting surface.

In another form in the second configuration the housing portion projects from the article to receive the projection member of the surface mounting bracket into the internal cavity to mount the article a predetermined distance from the upright mounting surface.

In another form in the second configuration the position of the article is adjustable with respect to the upright mounting surface.

In a third aspect the present invention accordingly provides a reversible mounting bracket for mounting a loudspeaker, the reversible mounting bracket in a first configuration adapted to mount the article substantially flush to a wall and in a second configuration, wherein the mounting bracket is reversed in orientation with respect to the loudspeaker, the mounting bracket is adapted to mount the article to a mounting member.

In another form the mounting member is a stand.

In another form the mounting member is a wall bracket.

BRIEF DESCRIPTION OF THE DRAWINGS

Illustrative embodiments of the present invention will be discussed with reference to the accompanying drawings wherein.

In the following description, like reference characters designate like or corresponding parts throughout the several views of the drawings.

TECHNICAL DESCRIPTION

The invention will have numerous applications, however for the purposes of description only, the invention will be described in relation to one application namely its use in relation to the mounting of a loudspeaker to an upright mounting support surface or to a stand. As would be apparent to those skilled in the art, the present invention may be applicable to all manner of mounting tasks which require the mounting of an article to either a stand or an upright support surface such as a wall or the like.

In some examples, the upright support surface may be substantially vertical such as in the case of the wall of a room, however as would be appreciated by those skilled in the art, the present invention may be applied to support surfaces or stands having various inclination or degrees of tilt with respect to the ground.

Figure 2:
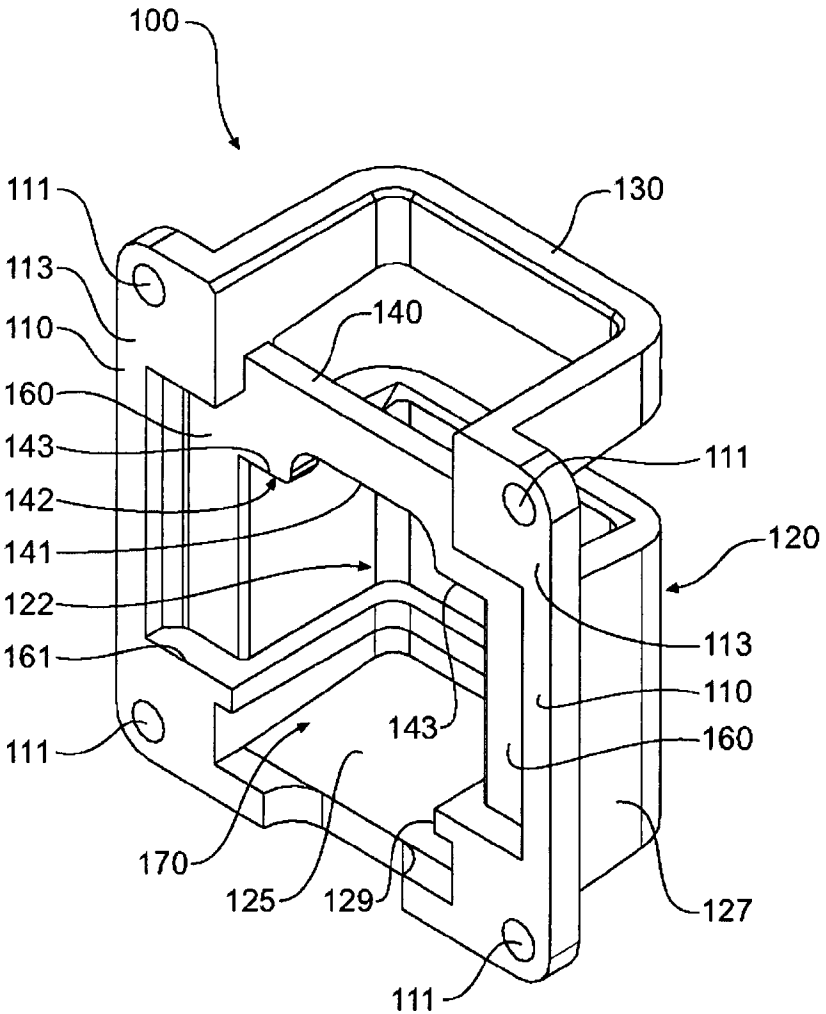
FIG. 2 is a rear perspective view of the mounting bracket illustrated in FIG. 1.
Figure 1:
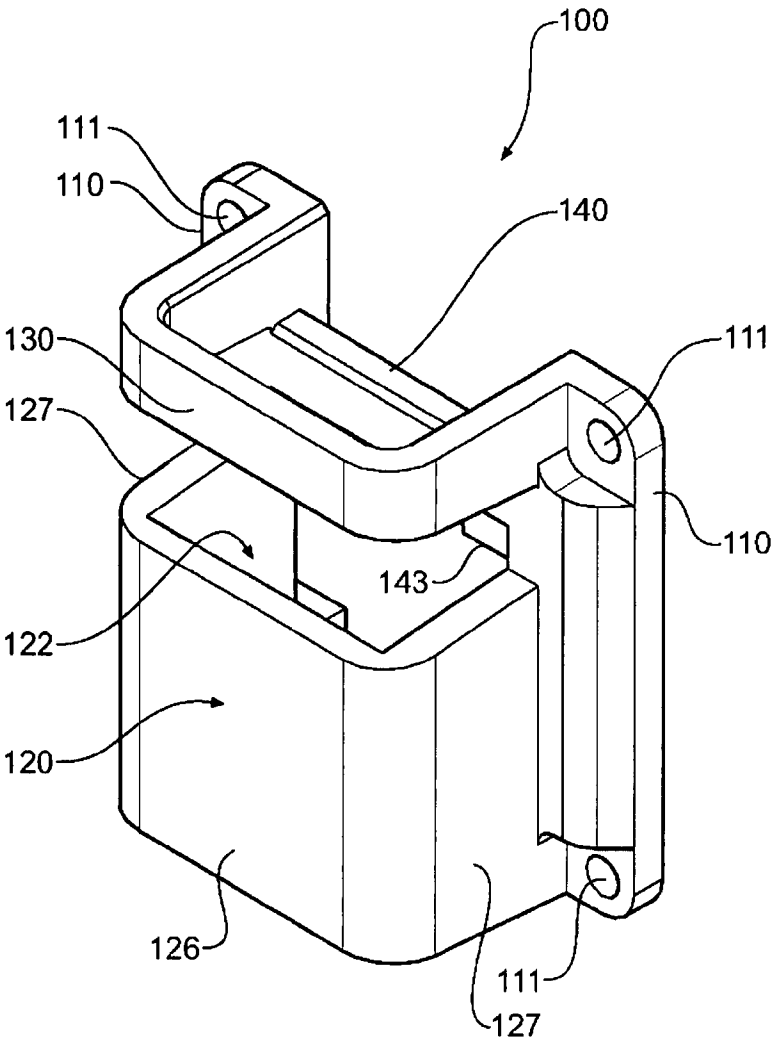
FIG. 1 is a front perspective view of a mounting bracket according to a first illustrative embodiment of the present invention.

Referring now to FIGS. 1 and 2, there are shown front and rear perspective views of a reversible mounting bracket 100 according to a first illustrative embodiment of the present invention. Mounting bracket 100 is of a unitary construction and consists of a pair of opposed side flange portions 110 having at their corners respective circular apertures or bolt holes 111, thereby forming a mounting plate.

Located at the base of mounting bracket 100 is an outwardly projecting open roofed housing portion 120 consisting of a bottom floor 125, a front face 126 and a pair of opposed side walls 127 and having an internal cavity or recess 122. A correspondingly shaped rectangular shaped bridging collar 130 extends from the top of mounting bracket 100. Located between bridging collar 130 and housing portion 120 is a bridging plate 140 extending between opposed side flange portions 110 and having a U-shaped cut-out portion 141 centrally located on the bottom edge 142 of bridging plate 140 having a pair of opposed abutment portions 143 located on each side of cut-out portion 141.

As best shown in FIG. 2, mounting bracket 100 includes a recessed region 160 formed as a cut-out in the rear faces 113 of the side flange portions 110. Recessed region 160 in turn surrounds rectangularly shaped aperture 170 bounded at the bottom by the rear edge of floor 125 of mounting bracket 100, at the sides by rear edges of side walls 127 of housing portion 120 and at the top by the bottom edge 142 of bridging plate 140. Internal cavity or recess 122 includes an horizontal alignment rib 129 extending around the inner surface of housing portion 120 and located in line with the bottom edge 161 of recessed region 160.

Figure 4:
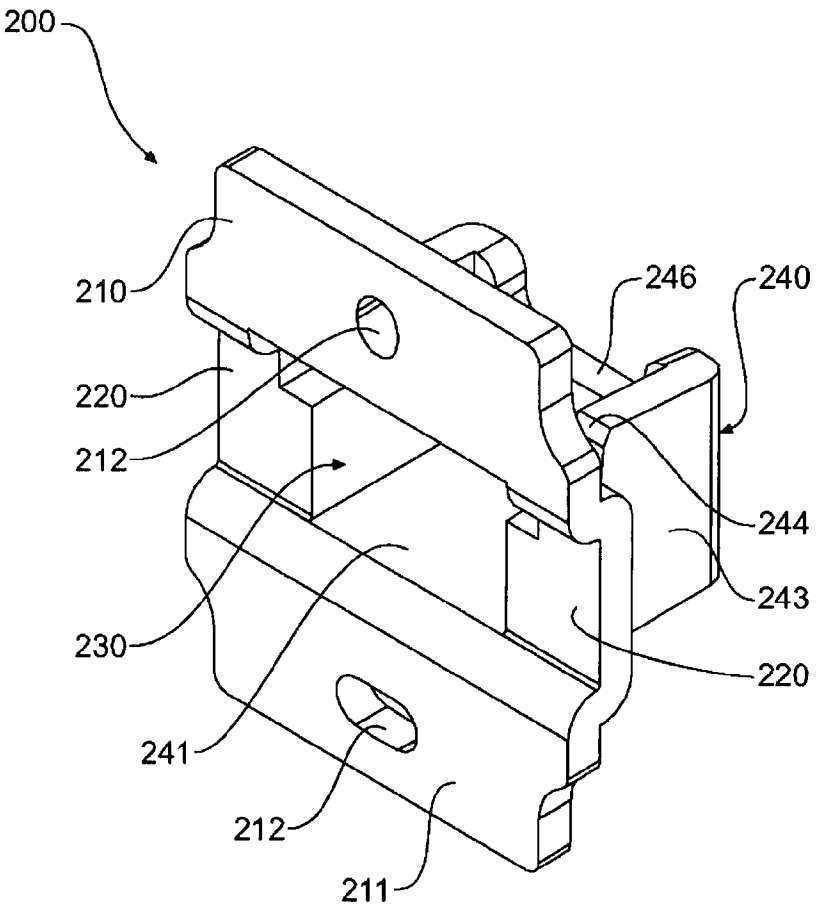
FIG. 4 is a rear perspective view of the wall bracket illustrated in FIG. 3.
Figure 3:
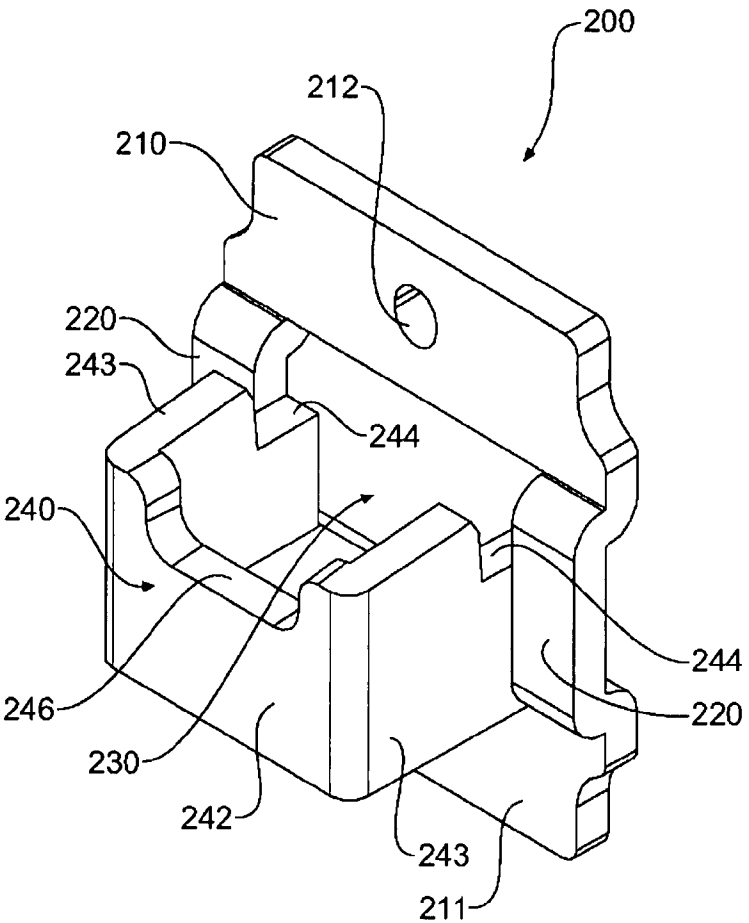
FIG. 3 is a front perspective view of a wall bracket used in combination with the mounting bracket illustrated in FIG. 1.
Figure 5:
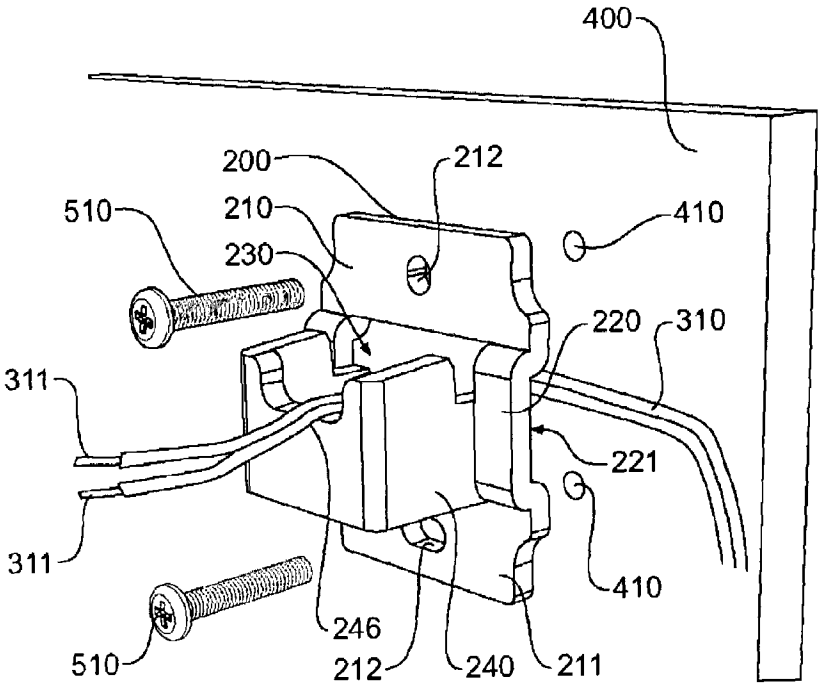
FIGS. 5 to 9 depict the various stages in the mounting of a loudspeaker to a wall employing the mounting bracket illustrated in FIG. 1 with the wall bracket illustrated in FIG. 3.
Figure 5:
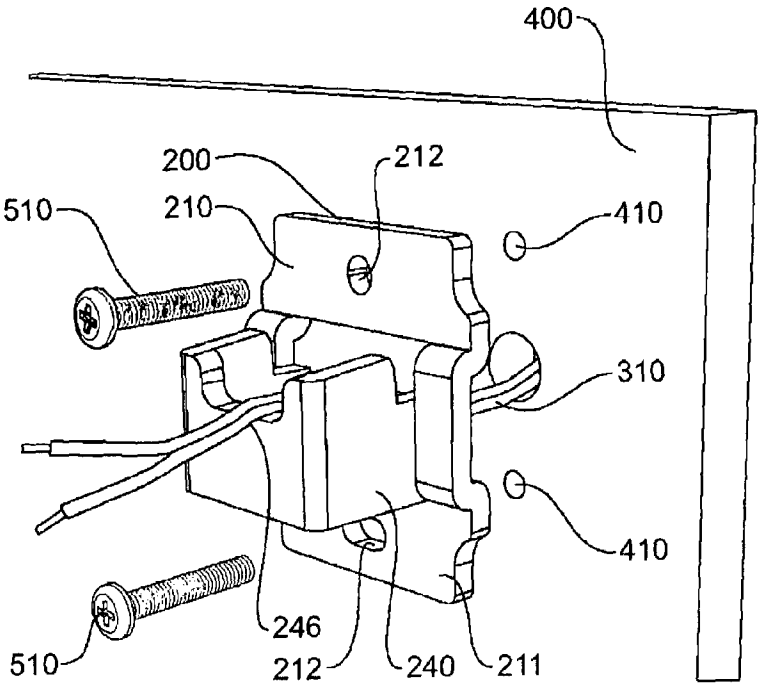

Referring now to FIGS. 3 and 4, there is shown front and rear perspective views of a wall or surface mounting bracket 200 that is used in combination with mounting bracket 100. Wall bracket 200 includes top and bottom flange portions 210, 211 each having a centrally located aperture or bolt hole 212. Extending between top and bottom flange portions 210, 211 is a pair of opposed vertically oriented raised bridging members 220 which connect top and bottom flange portions 210, 211 thereby forming a centrally located rectangular aperture 230.

Extending from bottom flange 211 and bridging members 220 is an open roofed projection member 240 consisting of a bottom floor 241, a front face 242 and a pair of opposed side walls 243 extending respectively from each bridging member 220. Side walls 243 each include a generally rectangular shaped cut-out portion 244 located adjacent to bridging members 220. Front face 242 further includes a centrally located U-shaped cut-out portion 246.

Referring now to FIGS. 5 to 9, there is shown the various stages of mounting a loudspeaker 300 to a wall or more generally an upright mounting surface 400 employing mounting bracket 100 in a first configuration. Speaker cable 310 is first threaded through an aperture 310 in mounting surface 400 or alternatively via the side opening or passage 221 created by the gap between the raised bridging member 220 and the mounting surface 400. In this illustrative embodiment, wall bracket 200 is mounted to mounting surface 400 by a pair of screws or bolts 510 which are inserted through corresponding apertures or bolt holes 212 in top and bottom flange portions 210, 211 and screwed into threaded apertures 410.

Figure 6:
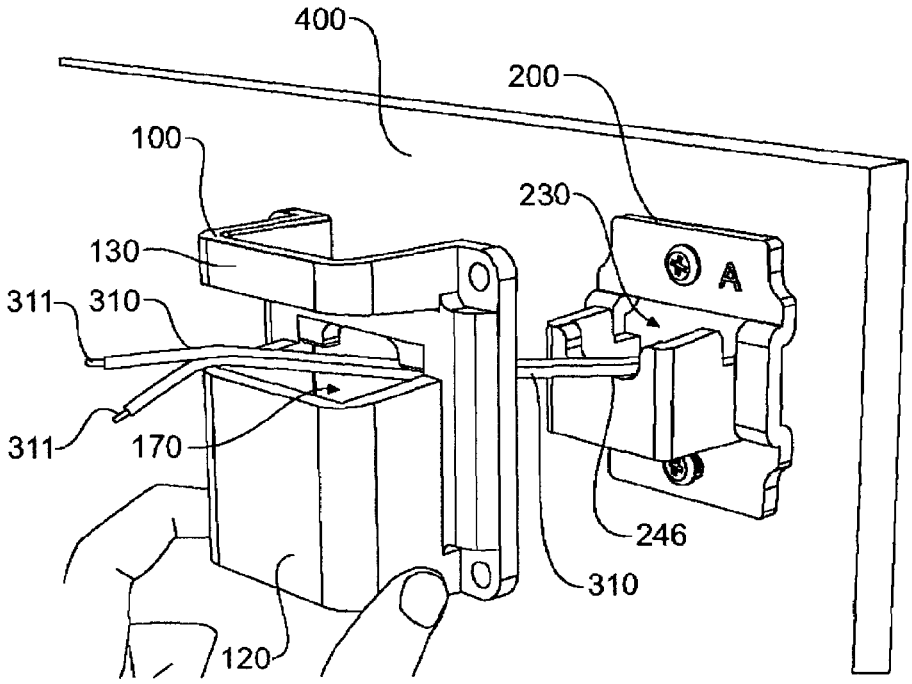
Figure 7:
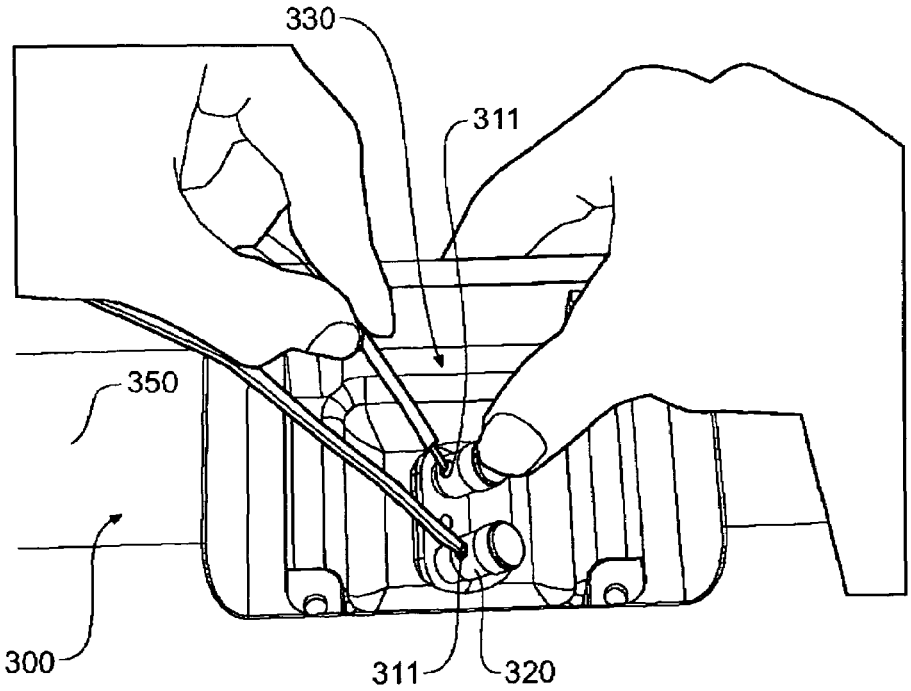

As shown in FIG. 6, speaker cable 310 is then threaded through the rectangular aperture 230 and seated in U-shaped cut-out portion 246 and further through mounting bracket 100 by virtue of aperture 170 and then over housing portion 120. The wire ends 311 of loudspeaker cable 310 may then be attached to connectors or terminals 320 which are located in the loudspeaker enclosure recess 330 located in the rear face 350 of loudspeaker 300 (as best shown in FIG. 7).

Mounting bracket 100 is then attached to the loudspeaker enclosure recess 330 by four screws or bolts 340 inserted through apertures or bolt holes 111 and into corresponding screw thread apertures 341 located at the four corners of enclosure recess 330. The shape of housing portion 120 and bridging collar 130 function to snugly fit within recess 330, thereby ensuring on assembly that the alignment of the loudspeaker is generally keyed to the direction of mounting bracket 100 with the final position of bracket 100 being determined once it has been bolted to loudspeaker enclosure recess 330 (as best shown in FIG. 8).

Although in this illustrative embodiment, the operation of mounting bracket 100 with wall bracket 200 has been described it will be apparent to those of ordinary skill in the art that mounting bracket 100 may be adapted to mount to any suitable surface mounting bracket.

Figure 8:
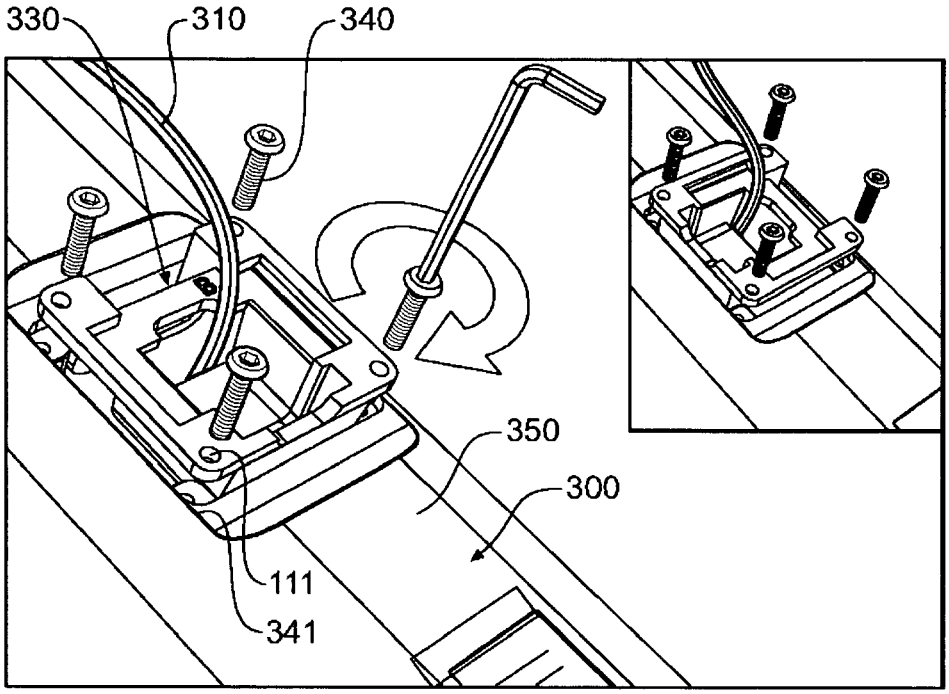
Figure 9:
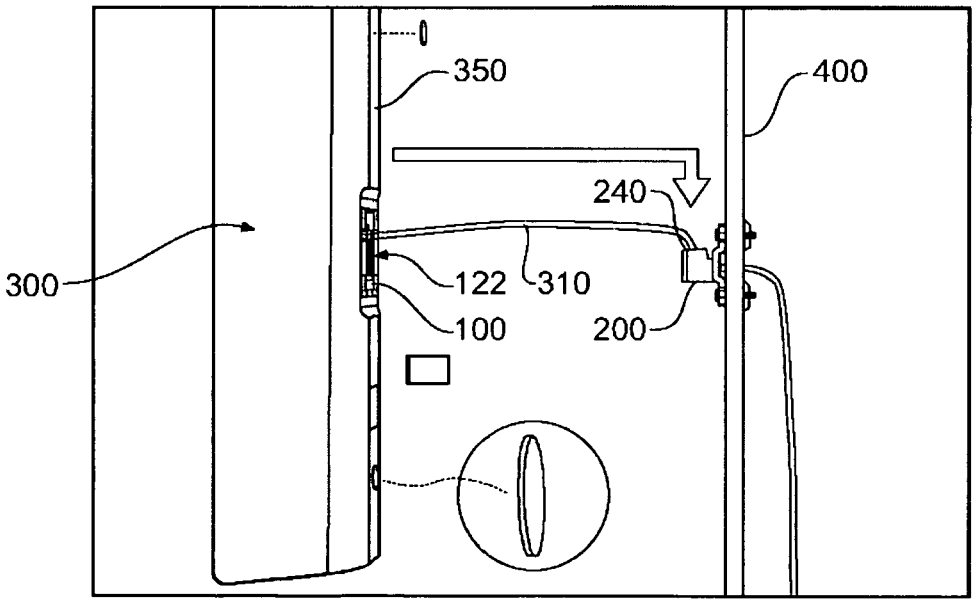

In this first illustrative embodiment, the loudspeaker may be mounted in a perpendicular direction (e.g. as in the case of a centre speaker) by simply rotating mounting bracket 100 an angle of 90 degrees in enclosure recess 330 (as shown in the corner view of FIG. 8).

Figure 10:
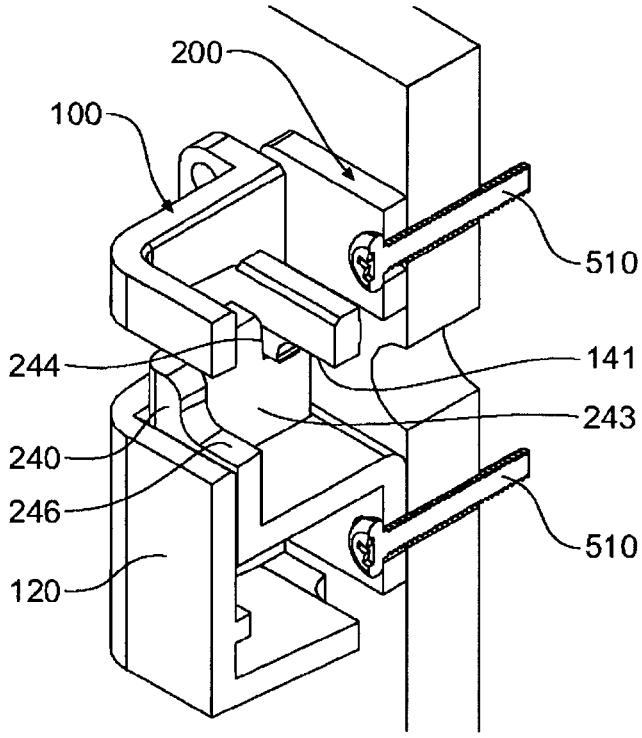
FIG. 10 is a sectional perspective view of the mounting bracket illustrated in FIG. 1 as mounted to the wall bracket illustrated in FIG. 3.

The final stage of installation simply involves placing mounting bracket 100 on wall bracket 200. Internal cavity 122 of mounting bracket 100 formed by housing portion 120 receives the projection member 240 of wall bracket guided by alignment rib 129. Furthermore, the raised bridging members 220 of wall bracket 200 seat within recessed region 160. Loudspeaker 300 and hence mounting bracket 100 can then be lowered allowing the abutment portions 143 located on each side of cut-out portion 141 of mounting bracket 100 to engage with the cut-out portions 244 located towards the rear of the side walls 243 of the projection member 240 of wall bracket 200, thereby securely mounting loudspeaker 300 flush to the wall surface 400 (as best shown in FIG. 10). When mounted, the cut-out portions 141, 246 of mounting bracket 100 and wall bracket 200 respectively line up to provide a passage for loudspeaker cable 310.

Figure 11:
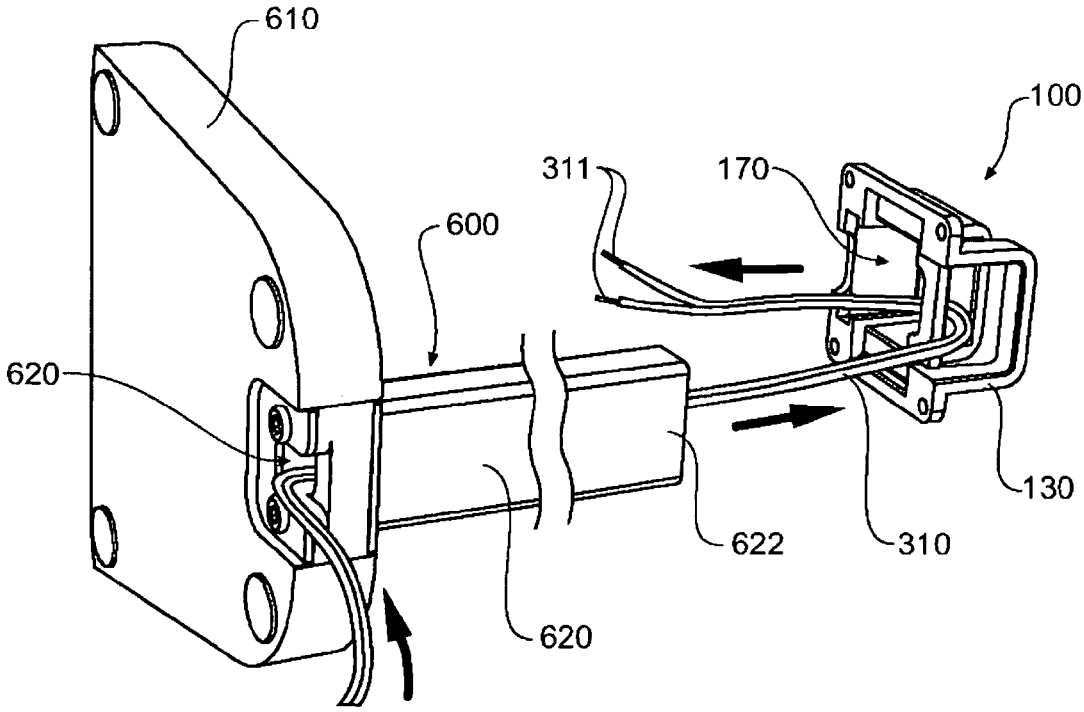
FIGS. 11 to 13 depict the various stages in the mounting of a loudspeaker to a stand employing the mounting bracket illustrated in FIG. 1.
Figure 12:
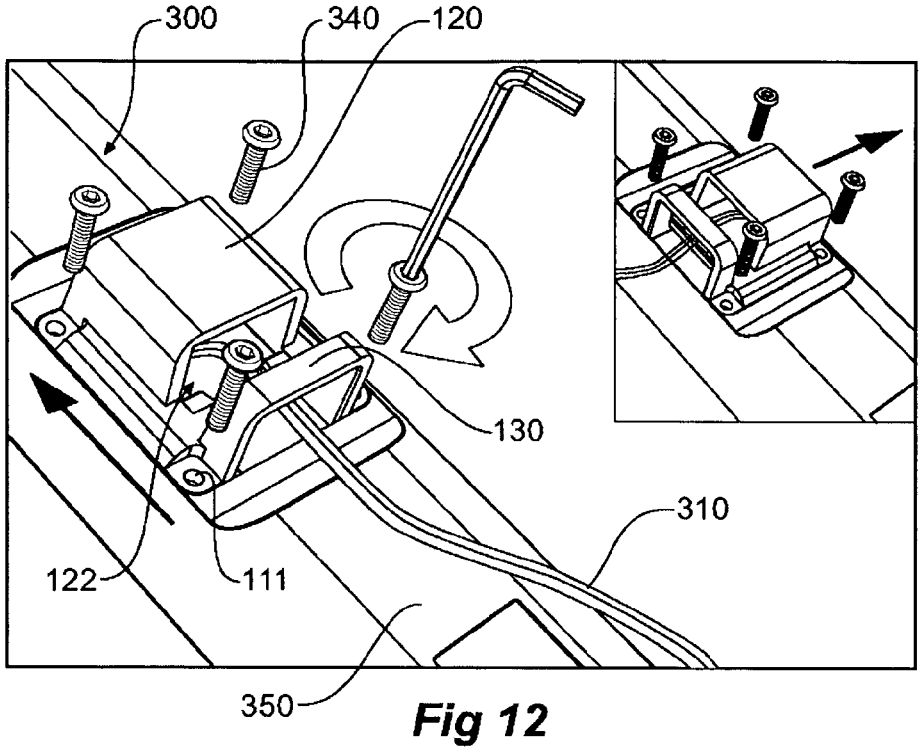
Figure 13:
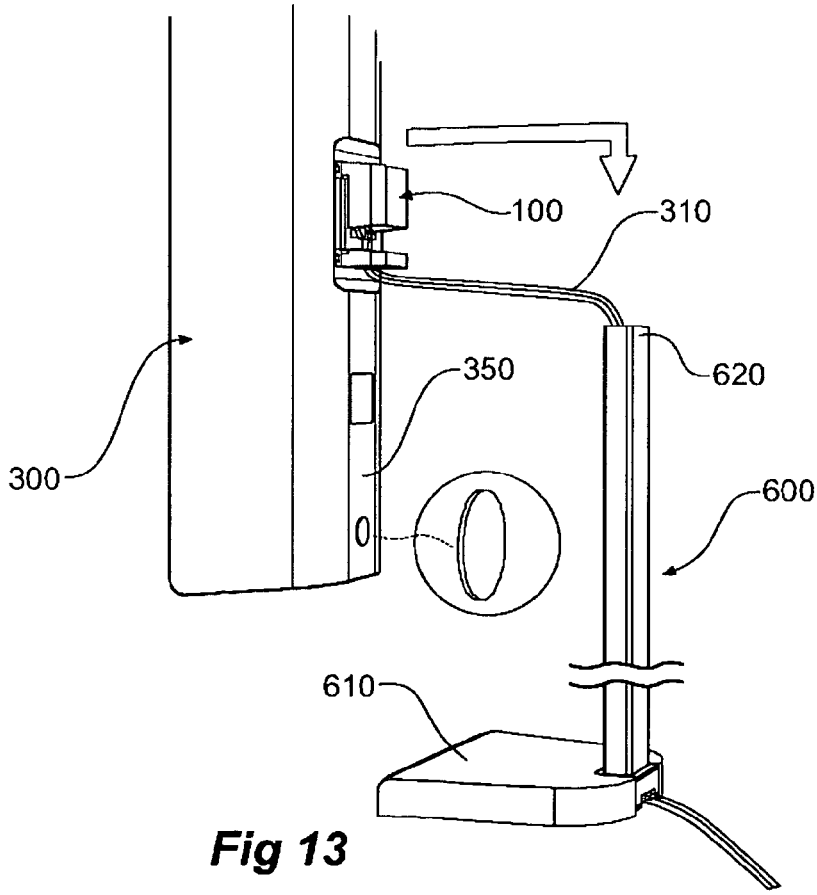
Figure 14:
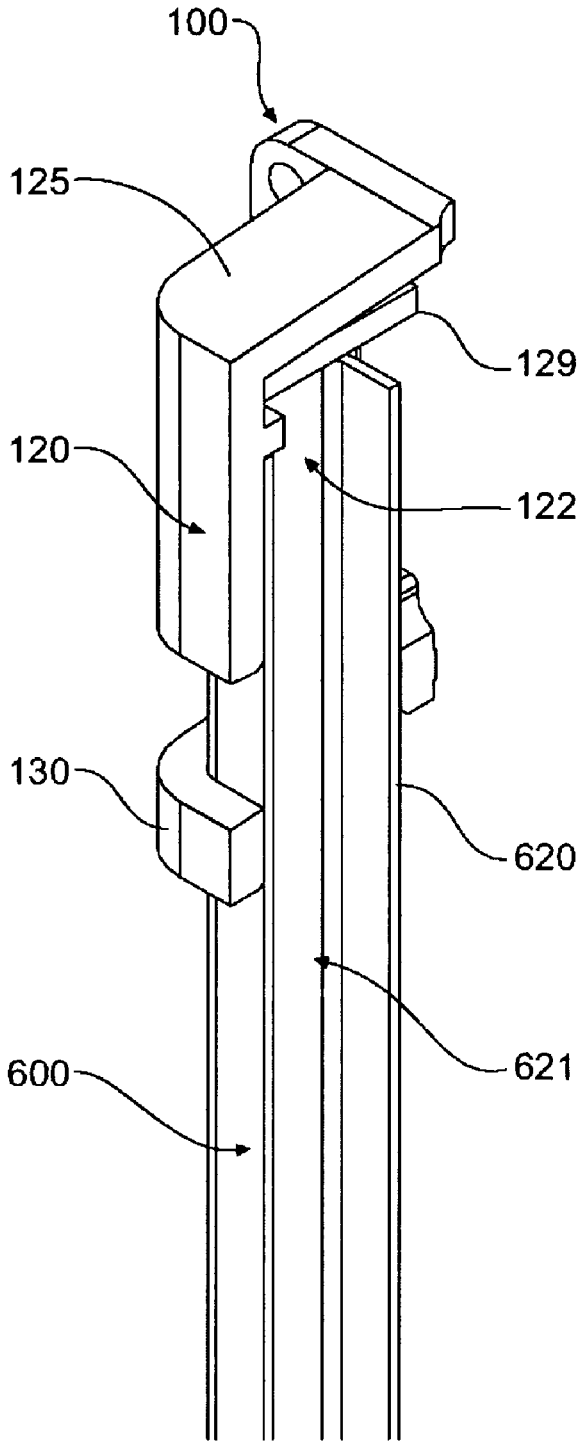
FIG. 14 is a sectional perspective view of the mounting bracket illustrated in FIG. 1 as mounted to the stand.

Referring now to FIGS. 11 to 13, there is shown the various stages of mounting a loudspeaker 300 to a mounting member such as a stand 600 employing mounting bracket 100 in a second configuration where mounting bracket 100 has a reversed orientation and protrudes or projects from loudspeaker 300. Stand 600 includes a stand base 610 and a post member 620 having an internal channel 621 to receive loudspeaker cable 310 which is threaded through internal channel 621 and out through an exit aperture 622 at the top of post member 620 where it can be further threaded through bridging collar 130 and then through rear aperture 170 at which point the wire ends 311 of loudspeaker cable 310 may be attached to connectors 320 (as shown in FIG. 7).

Mounting bracket 100 may then be attached to loudspeaker 300 in a similar way by four screws or bolts 340 inserted through apertures or bolt holes 111 and into corresponding screw thread apertures located at the four corners of enclosure recess 330. In this configuration, mounting bracket 100 is reversed in orientation with respect to loudspeaker 300. Once again, the loudspeaker may be mounted in a perpendicular direction (e.g. as in the case of a centre speaker) by simply rotating mounting bracket 100 an angle of 90 degrees in enclosure recess 330 (as shown in the corner view of FIG. 12).

While in this illustrative embodiment, mounting bracket 100 is rotated through 180 degrees in direction when changing from the first to the second configuration, it will be apparent to those skilled in the art that this is not essential to the functioning of the invention. As an example, bridging collar 130 may incorporate a closed roof portion thereby forming a housing portion whereas the original housing portion 120 may be open at both top and bottom ends.

In this second configuration, housing portion protrudes or projects from the rear face 350 of loudspeaker 300 and the internal cavity 122 and bridging collar 130 of mounting bracket 100 both function to receive the top portion of post member 620, thereby mounting loudspeaker 300 to stand 600 (as best seen in FIG. 13). In this configuration, alignment rib 129 functions as an abutment region or stop that abuts against the end of post member 620 allowing speaker cable 310 to enter enclosure recess 330. As would be apparent to those skilled in the art, the sectional shape of internal cavity 122 may be varied in accordance with the sectional profile of post member 620.

Figure 16:
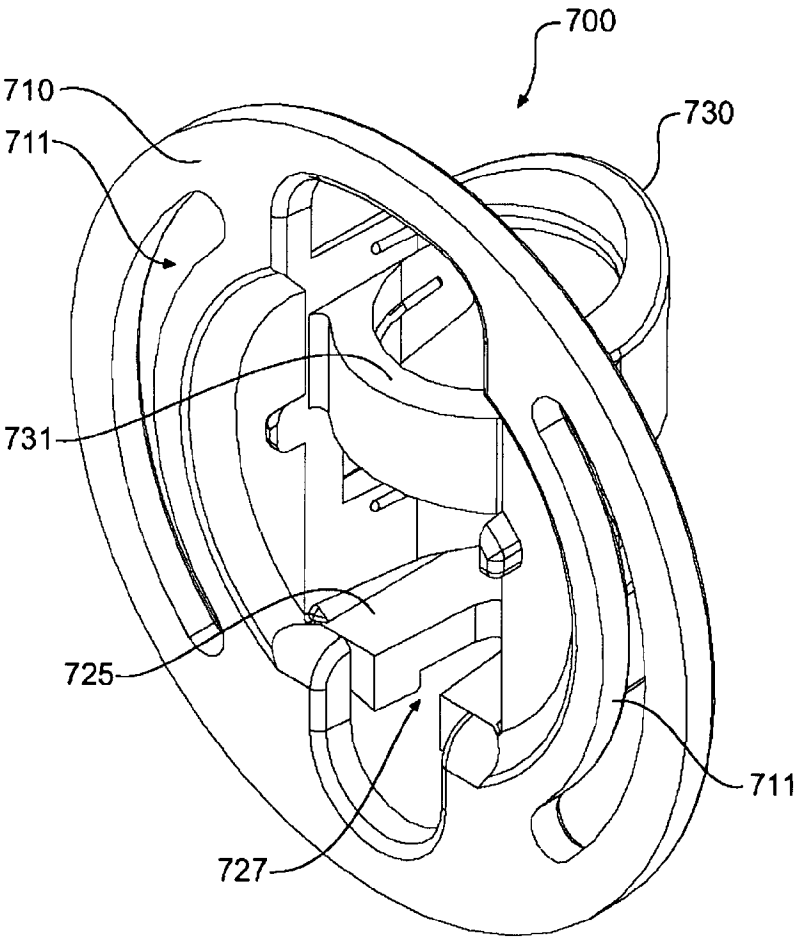
FIG. 16 is a rear perspective view of the mounting bracket illustrated in FIG. 15.
Figure 15:
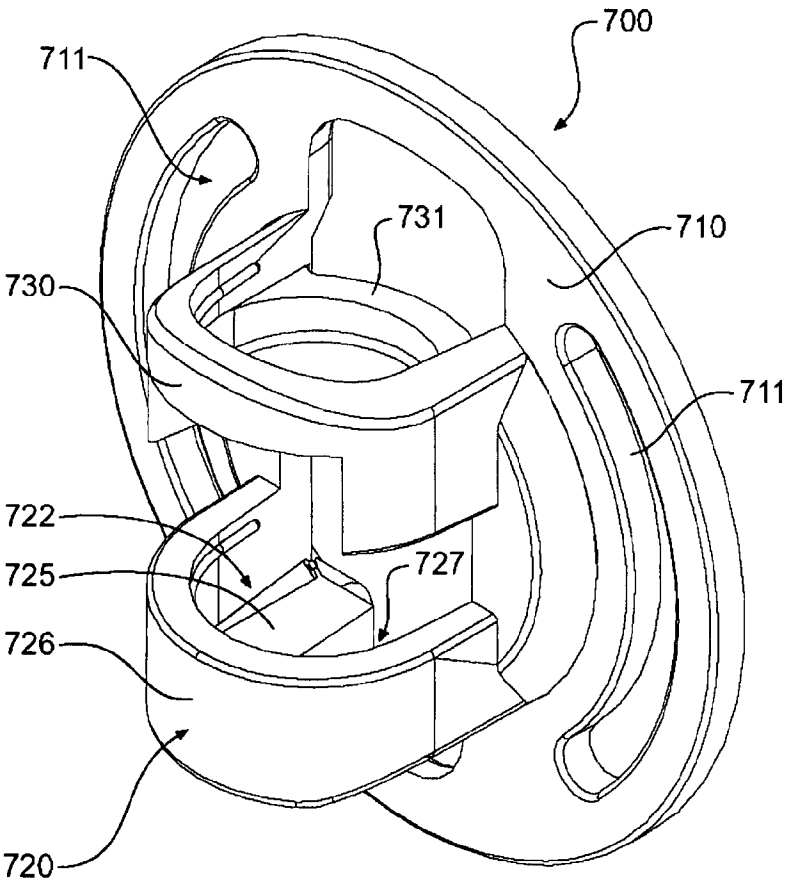
FIG. 15 is a front perspective view of a mounting bracket according to a second illustrative embodiment of the present invention.

Referring now to FIGS. 15 and 16, there is shown front and rear perspective views of a mounting bracket 700 according to a second illustrative embodiment of the present invention. Mounting bracket 700 is of a unitary construction and consists of an outer circular flange portion 710 having opposed arcuate slots 711, thereby forming a mounting plate.

Located at the base of mounting bracket 700 is an outwardly projecting open roofed housing portion 720 consisting of a bottom floor 725 incorporating a forwardly extending slot 727 and a curved part cylindrical front face 726 forming a part cylindrical shaped internal cavity or recess 722. A correspondingly shaped circular bridging collar 730 extends from the top of mounting bracket 700 and includes a circular shaped back portion 731.

Figure 18:
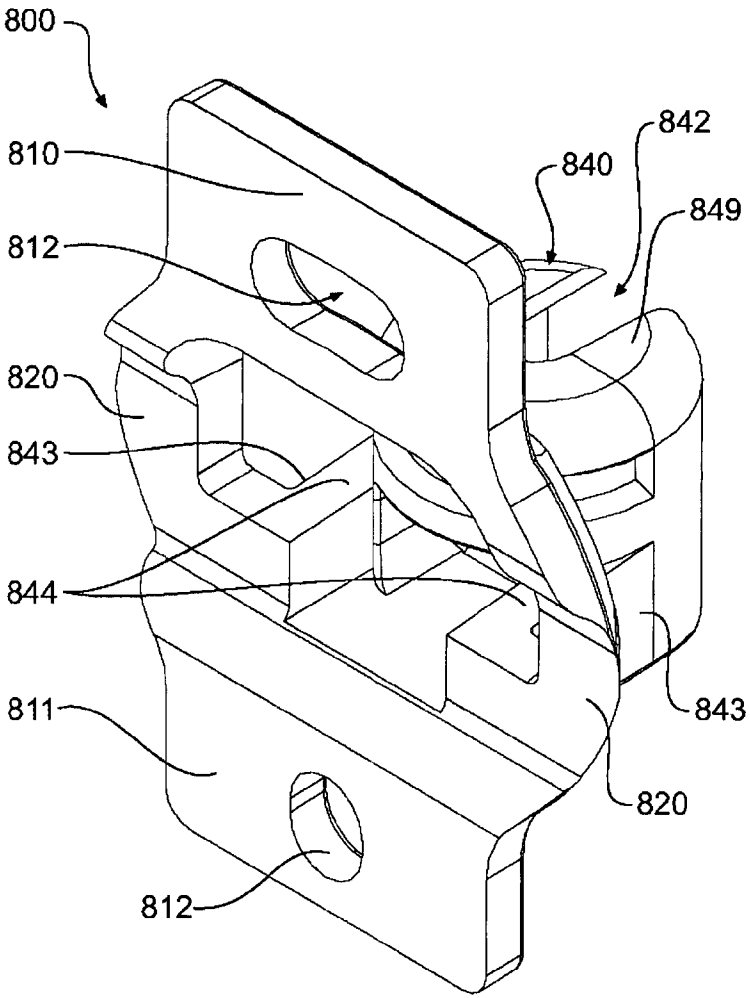
FIG. 18 is a rear perspective view of the wall bracket illustrated in FIG. 16.
Figure 17:
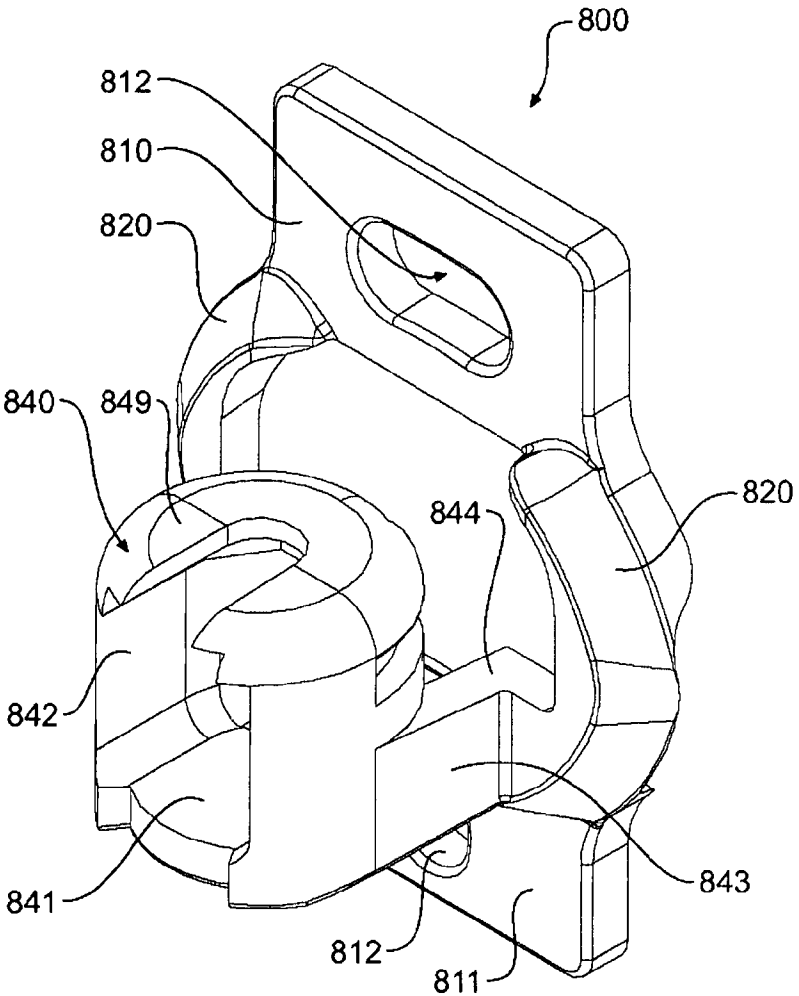
FIG. 17 is a front perspective view of a second type of wall bracket used in combination with the mounting bracket illustrated in FIG. 15.

Referring now to FIGS. 17 and 18, there is shown front and rear perspective views of a wall or surface mounting bracket 800 that is used in combination with mounting bracket 700. Wall bracket 800 includes top and bottom flange portions 810, 811 each having a centrally located aperture or bolt hole 812. Extending between top and bottom flange portions 810, 811 is a pair of opposed raised part circular bridging members 820 which connect top and bottom flange portions 810, 811 thereby forming a centrally located rectangular aperture 830 having top rounded corners.

Extending from bottom flange 811 and bridging members 820 is a generally cylindrically shaped projection member 840 incorporating a dome shaped roof 849 having a forwardly extending slot 842 that extends from the centre of dome shaped roof 849. Projection member 840 also includes a bottom floor 841 and a cut away rectangularly shaped front portion 846. Projection member 840 is supported by a pair of opposed side support members 843 that extend outwardly from the respective bridging portions 820 and which form respective shelf or ledge portions 844 located behind each side of projection member 840.

As would be apparent to one of ordinary skill in the art and by analogy to the mounting bracket 100 of the first illustrative embodiment of the invention, mounting bracket 700 in a first configuration may be employed in combination with wall bracket 800 to mount a loudspeaker to a wall by orienting the housing portion 720 so that it sits within the complementary recess located in the loudspeaker. Due to the generally circularly shaped profile of mounting bracket 700 and the presence of arcuate slots 711, mounting bracket 700 may be rotated to the desired direction with respect to loudspeaker, thereby allowing the loudspeaker to be mounted at any number of different directions.

In a similar manner to the mounting of mounting bracket 100 of wall bracket 200, the cylindrically shaped projection member 840 of wall bracket 800 will locate within the part cylindrical shaped internal cavity or recess 722 formed by the housing portion 720 of mounting bracket 700 with the part cylindrical front face 726 of the housing portion 720 seating on ledge portions 844. In this case, while the loudspeaker still sits substantially flush to the wall surface, the loudspeaker will be able to undergo a small amount of swivel thereby allowing the tilt direction of the loudspeaker to be fine tuned. The degree of swivel may be increased by extending the length of side support members 843 to allow a greater degree of clearance between the wall surface and the loudspeaker.

As has been described previously with respect to mounting bracket 100, mounting bracket 700 in a second configuration may be reversed in orientation with respect to loudspeaker to allow the mounting of the loudspeaker to a mounting member such as a stand as the housing portion 720 protrudes or projects from the loudspeaker. As internal cavity 722 of housing portion 720 is part cylindrical in shape, then the loudspeaker may be mounted on a corresponding cylindrically shaped post member, thereby allowing the loudspeaker to swivel left and right.

Figure 19:
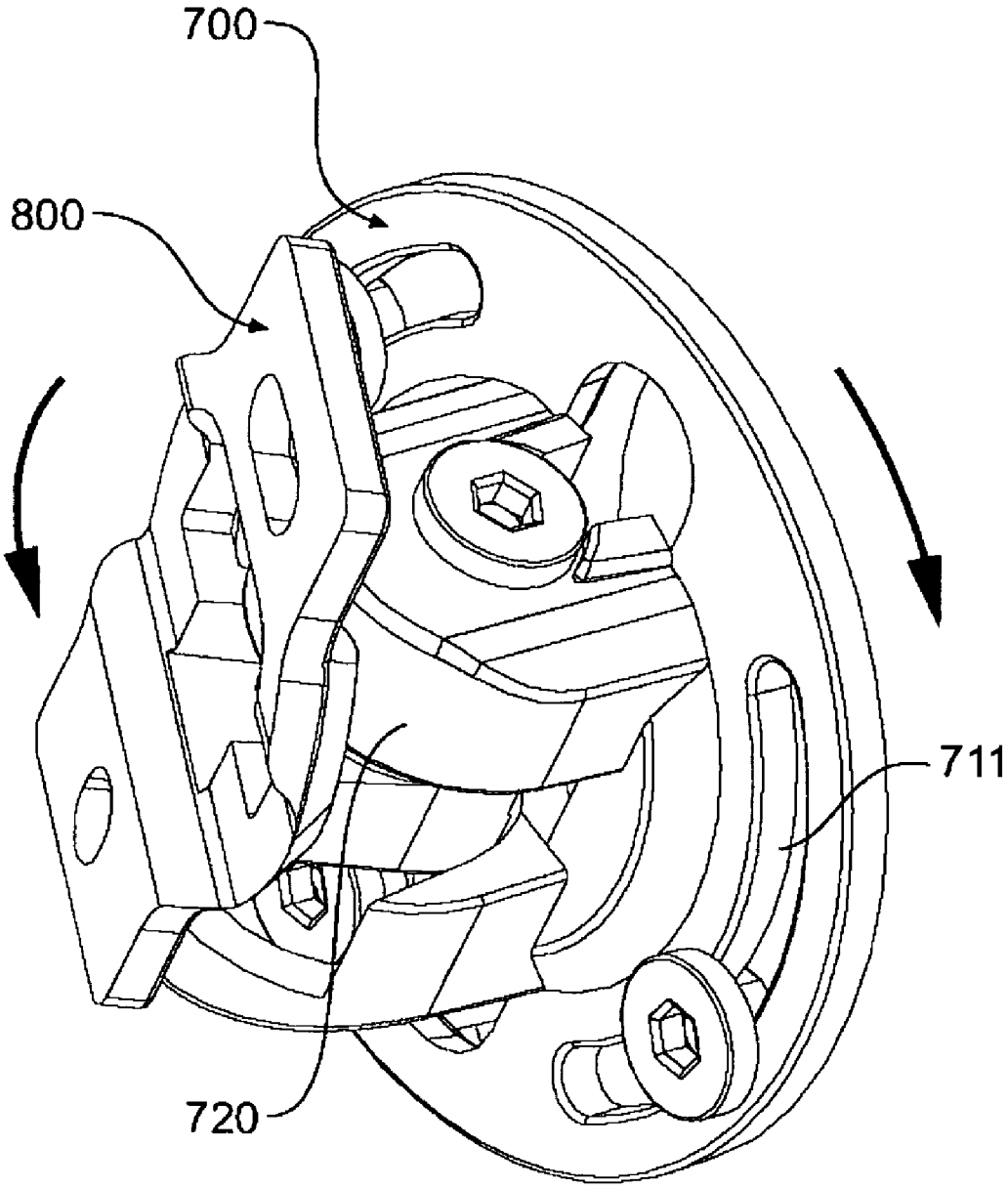
FIG. 19 is a perspective view of the mounting bracket illustrated in FIG. 15 as mounted to the wall bracket illustrated in FIG. 17.

Referring now to FIG. 19 there is shown a mounting arrangement incorporating mounting bracket 700 as oriented in the second configuration as described previously mounted to wall bracket 800. In this example, the cylindrically shaped projection member 840 of wall bracket 800 once again sits within the part cylindrical shaped internal cavity or recess 722 formed by the housing portion 720 of mounting bracket 700. However, in this case as the mounting bracket 700 is in the second configuration, the housing portion 720 projects or protrudes outwardly from the loudspeaker allowing the loudspeaker to be mounted a predetermined distance from the wall.

In this example, a nut and bolt arrangement 900 is located in corresponding slots 727, 842 thereby forming a securing means to secure the location of mounting bracket 700 with respect to wall bracket 800 and hence the position of the loudspeaker by frictionally engaging the floor 725 (or roof in this configuration) of housing portion 720 with the dome shaped roof 849 of cylindrically shaped projection member 840. As illustrated in FIG. 19, this arrangement allows for greater flexibility in the positioning of the loudspeaker by virtue of the degree of rotational freedom given by arcuate slots 711 and the further degree of rotational freedom given by the ability of the housing portion 720 to swivel with respect to the cylindrically shaped projection member 840 of wall bracket 800 and then be secured in place.

As would be apparent to those skilled in the art, this same arrangement may be adapted to a general mounting member having a complementary shape to the internal cavity or recess of the housing portion of mounting bracket. In this manner, a mounting bracket assembly consisting of mounting bracket 700 and surface mounting or wall bracket 800 is able to provide three mounting options wherein the mounting bracket in a first configuration allows a loudspeaker to be mounted substantially flush to an upright surface such as a wall or the like employing the wall bracket 800. In a second configuration, mounting bracket 700 can function either to mount the loudspeaker to a mounting member such as a stand (in a second option) or a predetermined distance from a wall (in a third option) by once again mounting the loudspeaker to the wall bracket 800.

A brief consideration of the above described embodiments will indicate that the invention provides a mounting bracket which is effective to reduce the number of different types of mounting brackets required to mount an article such as a loudspeaker in different situations. Accordingly, in the example of having to install multiple speakers in association with a home cinema system only one type of mounting bracket need be supplied. In addition, the shape and configuration of mounting bracket 100 (and wall bracket 200) readily allows it to be injection moulded out of a plastic such as glass filled nylon, thereby also reducing the cost of the mounting bracket.

As would also be apparent to those skilled in the art, the present mounting bracket would be readily applicable to the mounting of an article having a connection line that connects to a connector located on the article. Some examples of such articles include, but are not limited to, gas heating devices having a gas connection line, lighting devices having standard electrical plug and cable arrangement or pneumatic devices having a connectorised air hose attachment arrangement.

The reference to any prior art in this specification is not, and should not be taken as, an acknowledgement of any form of suggestion that such prior art forms part of the common general knowledge.

Although illustrative embodiments of the present invention have been described in the foregoing detailed description, it will be understood that the invention is not limited to the embodiments disclosed, but is capable of numerous rearrangements, modifications and substitutions without departing from the scope of the invention as set forth and defined by the following claims.

The invention claimed is:

1. A reversible mounting bracket for mounting an article, the reversible mounting bracket in a first configuration adapted to mount the article substantially flush to an upright mounting surface and in a second configuration, wherein the mounting bracket is reversed in orientation with respect to the article, the mounting bracket is adapted to mount the article to a mounting member and wherein the reversible mounting bracket further includes a housing portion, the housing portion in the first configuration adapted to seat within a recess or cavity located on the article and in the second configuration the housing portion is adapted to receive a mounting portion of the mounting member.

2. The reversible mounting bracket of claim 1, wherein in the second configuration the housing portion projects from the article to receive the mounting portion of the mounting member.

3. The reversible mounting bracket of claim 2, wherein in the second configuration the housing portion includes an internal cavity to receive the mounting portion of the mounting member.

4. The reversible mounting bracket of claim 3, wherein in the first configuration the internal cavity of the housing portion receives a projection member of a surface mounting bracket to mount the article substantially flush to the upright mounting surface.

5. The reversible mounting bracket of claim 1, wherein the mounting member is a stand.

6. The reversible mounting bracket of claim 1, wherein the mounting bracket is adapted to allow the article to be mounted in a plurality of directions.

7. The reversible mounting bracket of claim 6, wherein the reversible mounting bracket is adapted to allow the article to be mounted either horizontally or vertically.

8. The reversible mounting bracket of claim 1, wherein the article includes at least one connector located within the recess or cavity of the article and wherein the mounting bracket is adapted to allow a connection line to access the at least one connector.

9. The reversible mounting bracket of claim 8, wherein the connection line is an electrically conductive cable.

10. The reversible mounting bracket of claim 1, wherein the mounting bracket is of unitary construction.

11. The reversible mounting bracket of claim 1, wherein the article is a loudspeaker.

12. A mounting bracket assembly for mounting an article, the mounting bracket assembly including a reversible mounting bracket and a surface mounting bracket, wherein the reversible mounting bracket in a first configuration is adapted to mount the article to the surface mounting bracket attached to an upright mounting surface so that the article is substantially flush to the upright mounting surface and in a second configuration, wherein the mounting bracket is reversed in orientation with respect to the article, the mounting bracket is adapted to mount the article to the surface mounting bracket at a predetermined distance from the upright mounting surface and wherein the reversible mounting bracket further includes a housing portion having an internal cavity and the surface mounting bracket includes a complementary shared projection member to the internal cavity of the housing portion for mounting the reversible mounting bracket.

13. The mounting bracket assembly of claim 12, wherein in the first configuration the internal cavity of the housing portion receives the projection member of the surface mounting bracket to mount the article substantially flush to the upright mounting surface.

14. The mounting bracket assembly of claim 12, wherein in the second configuration the housing portion projects from the article to receive the projection member of the surface mounting bracket into the internal cavity to mount the article a predetermined distance from the upright mounting surface.

15. The mounting bracket assembly of claim 14, wherein in the second configuration the position of the article is adjustable with respect to the upright mounting surface.

16. A reversible mounting bracket for mounting a loudspeaker, the reversible mounting bracket in a first configuration adapted to mount the loudspeaker substantially flush to a wall and in a second configuration, wherein the mounting bracket is reversed in orientation with respect to the loudspeaker, the mounting bracket is adapted to mount the loudspeaker to a mounting member and wherein the reversible mounting bracket further includes a housing portion, the housing portion in the first configuration adapted to seat within a recess or cavity located on the loudspeaker and in the second configuration the housing portion is adapted to receive a mounting portion of the mounting member.

17. A reversible mounting bracket for mounting a loudspeaker as claimed in claim 16, wherein the mounting member is a stand.

18. A reversible mounting bracket for mounting a loudspeaker as claimed in claim 16, wherein the mounting member is a wall bracket.

* * * * *